US009586721B2

(12) United States Patent
McCurry

(10) Patent No.: US 9,586,721 B2
(45) Date of Patent: Mar. 7, 2017

(54) ADJUSTABLE SUSPENDED ROLL PACKAGING SYSTEM

(71) Applicant: Marshane Corporation, Anderson, SC (US)

(72) Inventor: Greg McCurry, Anderson, SC (US)

(73) Assignee: Marshance Corporation, Anderson, SC (US)

( * ) Notice: Subject to any disclaimer, the term of this patent is extended or adjusted under 35 U.S.C. 154(b) by 0 days.

(21) Appl. No.: 14/832,337

(22) Filed: Aug. 21, 2015

(65) Prior Publication Data

US 2016/0052671 A1 Feb. 25, 2016

Related U.S. Application Data

(60) Provisional application No. 62/039,973, filed on Aug. 21, 2014.

(51) Int. Cl.

| | |
|---|---|
| ***B65D 19/44*** | (2006.01) |
| ***B65D 19/06*** | (2006.01) |
| ***B65D 85/66*** | (2006.01) |

(52) U.S. Cl.

CPC ..... *B65D 19/44* (2013.01); *B65D 19/06* (2013.01); *B65D 85/66* (2013.01); *B65D 2519/0082* (2013.01); *B65D 2519/00273* (2013.01); *B65D 2519/00293* (2013.01); *B65D 2519/00323* (2013.01); *B65D 2519/00333* (2013.01); *B65D 2519/00985* (2013.01)

(58) Field of Classification Search

CPC ..... B65D 19/06; B65D 19/44; B65D 85/66; B65D 2519/00273; B65D 2519/00293; B65D 2519/00323; B65D 2519/00333; B65D 2519/0082; B65D 2519/00985; B65D 71/0096

USPC ..... 206/386, 389, 391, 397–403, 412–416, 206/595–600; 108/54.1, 55.1, 55.3, 55.5

See application file for complete search history.

(56) References Cited

U.S. PATENT DOCUMENTS

| | | | | |
|---|---|---|---|---|
| 2,287,740 A * | 6/1942 | Klouman | F27D 3/12 108/54.1 |
| 2,903,217 A * | 9/1959 | Collins | B65D 19/38 108/54.1 |
| 3,238,697 A | 3/1966 | Zucker | |
| 3,337,036 A | 8/1967 | Peterson | |
| 3,502,237 A | 3/1970 | Verhein et al. | |

(Continued)

*Primary Examiner* — Bryon Gehman

(74) *Attorney, Agent, or Firm* — McNair Law Firm, P.A.; Seann P. Lahey

(57) ABSTRACT

A base platform carrying a plurality of lower rail members on an upper surface. A pair of opposing laterally spaced end plates engaging the lower rail members. A series of lower positioning teeth formed in the lower rail members. A series of complementary lower connecting teeth included on the end plates engaging the lower positioning teeth. A plurality of upper rail members carried by the end plates. A series of upper positioning teeth formed in the upper rail members. A series of complementary upper connecting teeth included on the end plates engaging the upper positioning teeth of the upper rail members securing the end plates to the upper rail members. The series of upper and lower connecting teeth provide for the end plates to be repositionable along at least a portion of the upper and lower rail members to adjust spacing between the end plates to accommodate various roll sizes.

12 Claims, 11 Drawing Sheets

(56) References Cited

U.S. PATENT DOCUMENTS

| | | | | | |
|---|---|---|---|---|---|
| 3,796,340 | A * | 3/1974 | Piggott | B65D 21/0212 206/600 |
| 4,042,107 | A | 8/1977 | Kendig | |
| 4,151,914 | A | 5/1979 | Blatt | |
| 4,231,475 | A | 11/1980 | Kessler | |
| 4,401,217 | A | 8/1983 | Blatt | |
| 5,423,428 | A * | 6/1995 | Selz | B60P 7/0869 206/386 |
| 5,579,918 | A | 12/1996 | McCurry | |
| 5,657,887 | A * | 8/1997 | Smith | B65D 19/10 108/55.1 |
| 6,073,768 | A | 6/2000 | McCord | |
| 6,098,804 | A | 8/2000 | Bartholomew | |
| 6,315,122 | B1 | 11/2001 | McCord | |
| 6,408,768 | B1 | 6/2002 | Giampavolo | |
| 7,325,691 | B2 | 2/2008 | Siy | |
| 7,699,167 | B2 * | 4/2010 | Voissem | B65D 71/0096 206/391 |
| 8,701,882 | B2 * | 4/2014 | Voissem | B65D 71/0096 206/391 |
| 2005/0082192 | A1 | 4/2005 | Smarr | |
| 2012/0318954 | A1 | 12/2012 | Overley | |

* cited by examiner

ADJUSTABLE SUSPENDED ROLL PACKAGING SYSTEM

BACKGROUND OF THE INVENTION

1) Field of the Invention

The present invention relates to crate packaging systems, and more particularly, to an adjustable suspended roll packaging systems for storing and shipping large rolls of wound sheet material, such as fabric or plastic, which are carried on elongated cores.

2) Description of Related Art

In various manufacture industries, sheet material such as fabric is often shipped in elongated cylindrical rolls utilizing a supporting elongated core. This is also true for the shipping of plastic film and other such materials that can be wound around an elongated core. Difficulty arises from the material handling viewpoint in that the sizes of the material being shipped can vary in the length of the cores, as well as the width. The variations in the material sizes generally depend upon the particular requirements of the customer and thus require custom packaging solutions for a given roll.

The prior art largely teaches systems in which the elongated material rolls are shipped on pallets having fixed dimensions. The rolls are positioned in end plates having a central opening for receiving the elongated cores. The end plates are secured to the pallets at pre-defined locations, and are not adjustable or repositionable. Accordingly, since the material rolls often vary in length, different sizes of pallets are used to ship the material rolls and a large quantity of different size pallets must be kept in inventory.

The use of pallets having various sizes is inconvenient and expensive. To accommodate for the various sizes of rolls which may be required to be shipped, every warehouse may have over 50 different types of pallets on hand having various widths and lengths with numerous quantities of each type of pallet. Accordingly, there is an excessive amount of money and storage space tied up in pallets which are on hand solely for a particular size shipping job which may or may not be demanded by a customer.

Some efforts have been made in the prior art to provide adjustability to the material roll packaging systems to reduce this problem. However, these systems lack durability and/or ease of use in the connections used to secure the end plates. As such, the systems are cumbersome and require multiple people working in concert to adjust the components. Further, impacts sustained during the normal shipping process can lead to a failure of the packaging system and damage to the material roll.

Accordingly, it is an object of the present invention to provide an adjustable packaging system for suspending material rolls which is easily adjustable by a single person to accommodate different roll lengths, as well as having sufficiently durable construction and arrangement able to survive normal impacts sustained during shipping.

SUMMARY OF THE INVENTION

The above objectives are accomplished according to the present invention by providing an adjustable suspended roll packaging system comprising a base platform; a plurality of lower rail members are carried by an upper surface of the base platform; a first end plate engages the lower rail members; a second end plate engages the lower rail members in an opposing laterally spaced arrangement with the first end plate; a series of lower positioning teeth are formed in each of the lower rail members; a series of complementary lower connecting teeth are included on each of the first and second end plates engage the lower positioning teeth of the lower rail members securing the first and second end plates to the lower rail members; a plurality of upper rail members are carried by the first and second end plates; a series of upper positioning teeth are formed in each of the upper rail members; a series of complementary upper connecting teeth are included on each of the first and second end plates engaging the upper positioning teeth of the upper rail members securing the first and second end plates to the upper rail members; and, wherein the series of upper and lower connecting teeth provide for the first and second end plates to be repositionable along at least a portion of the upper and lower rail members to adjust the spacing between the first and second end plates.

In a further advantageous embodiment, the upper rail members extend from the first end plate to the second end plate and interconnect an upper edge portion on each of the first and second end plates.

In a further advantageous embodiment, the upper rail members extend parallel with the lower rail members.

In a further advantageous embodiment, the upper positioning teeth on the upper rail members extend along the length of upper rail members from a first distal end portion to a second distal end portion.

In a further advantageous embodiment, a plurality of upper slots are disposed in an upper edge portion on each of the first and second end plates, and the upper connecting teeth disposed in the upper slots, wherein the upper rail members are received in the upper slots so that the upper positioning teeth of the upper rail members engage the upper connecting teeth in the upper slots in interlocking engagement.

In a further advantageous embodiment, the upper rail members include upper positioning teeth disposed on opposite side surfaces, and the upper slots include upper connecting teeth on opposing side surfaces so that a first side surface of the upper slots engage with a first side surface of the upper rail members in interlocking engagement, and a second side surface of the upper slots engage with a second side surface of the upper rail members in interlocking engagement.

In a further advantageous embodiment, the lower rail members extend from the first end plate to the second end plate and interconnect a lower edge portion on each of the first and second end plates.

In a further advantageous embodiment, a notch is included in each lower corner of the first and second end plates receiving the lower rail members, and the lower connecting teeth disposed in the notches engaging the lower positioning teeth of the lower rail members.

In a further advantageous embodiment, the lower positioning teeth on the lower rail members extend along the length of lower rail members from a first distal end portion to a second distal end portion.

In a further advantageous embodiment, a plurality of lower slots are disposed in a lower edge portion on each of the first and second end plates, and the lower connecting teeth disposed in the lower slots, wherein the lower rail members are received in the lower slots so that the lower positioning teeth of the lower rail members engage the lower connecting teeth in the lower slots in interlocking engagement.

In a further advantageous embodiment, the lower rail members include lower positioning teeth disposed on opposite side surfaces, and the lower slots include lower connecting teeth on opposing side surfaces so that a first side surface of the lower slots engage with a first side surface of the lower rail members in interlocking engagement, and a second side surface of the lower slots engage with a second side surface of the lower rail members in interlocking engagement.

In a further advantageous embodiment, a strap slots is disposed in a distal end portion of the lower rail members for receiving a securing strap.

In a further advantageous embodiment, each tooth of the upper and lower connecting teeth and the upper and lower positioning teeth has two inclined engaging surfaces intersecting at a peak in which opposing tooth engaging surfaces are angled at approximately 60 degrees relative to each other.

In a further advantageous embodiment, the series of lower positioning teeth are formed in the upper surface of the base platform. Further, at least one connecting tooth is disposed on a lower edge surface of each the first and second end plates engaging the lower positioning teeth on the base platform in interlocking engagement.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1A:
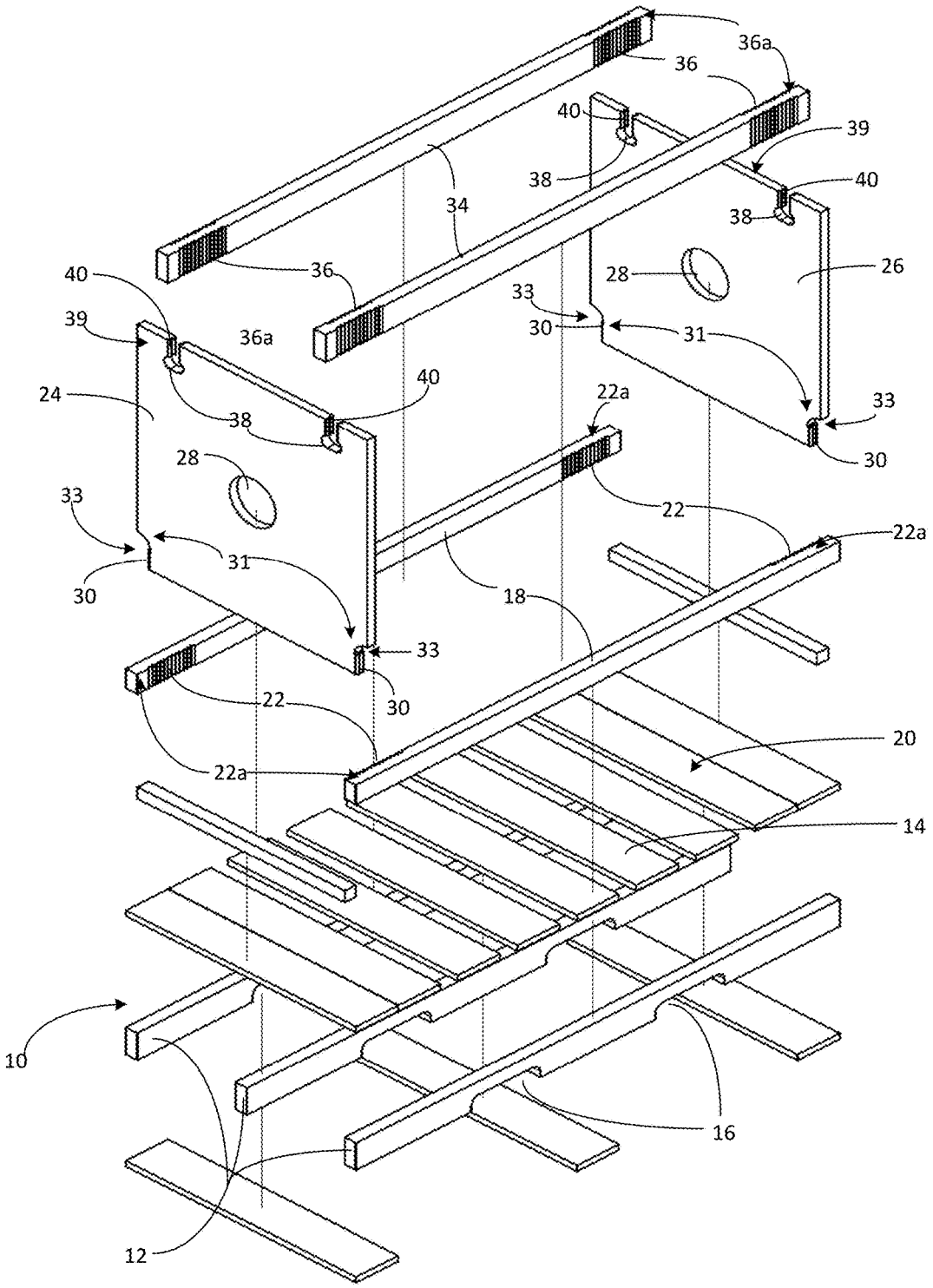
FIGS. 1A-1E show various aspects of a first embodiment of an adjustable suspended roll packaging system according to the present invention.
Figure 1B:
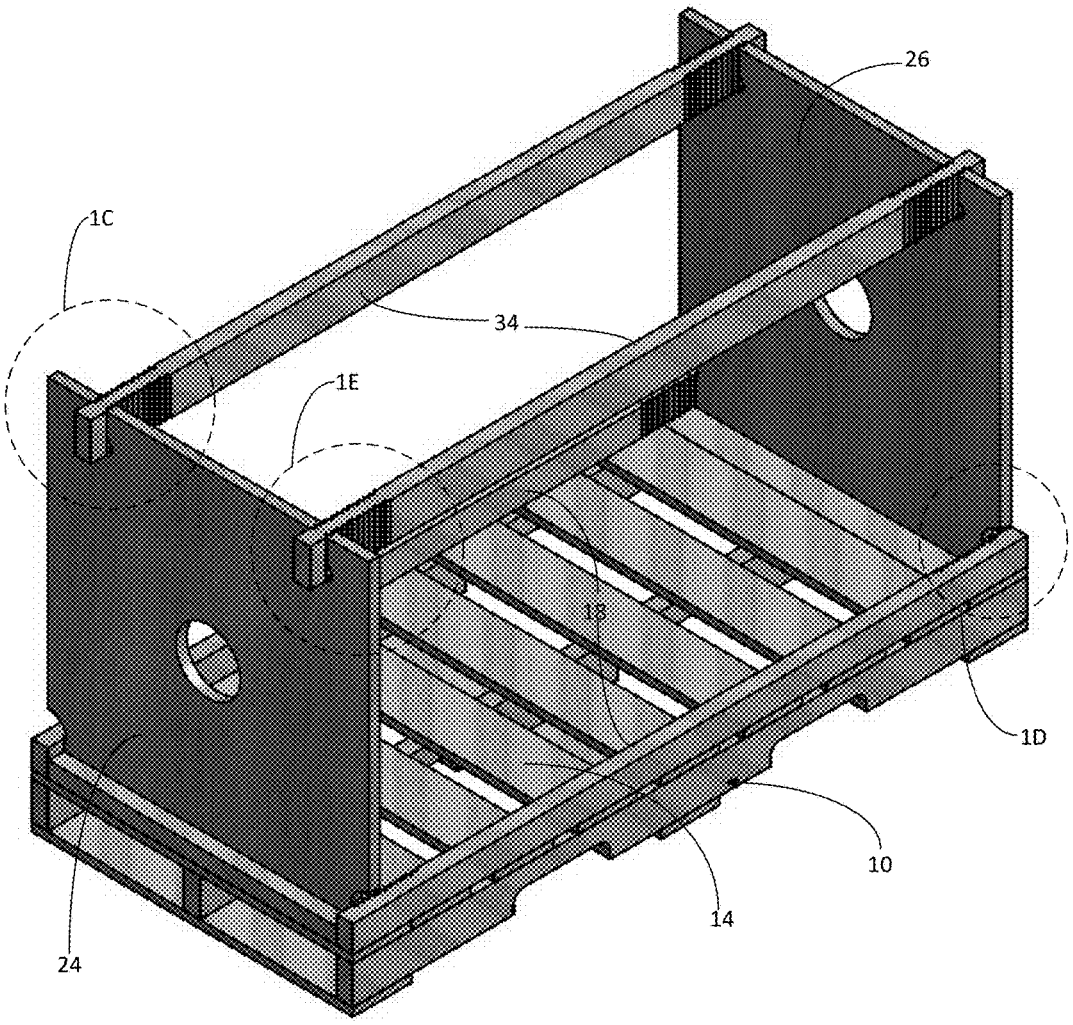
Figure 1C:
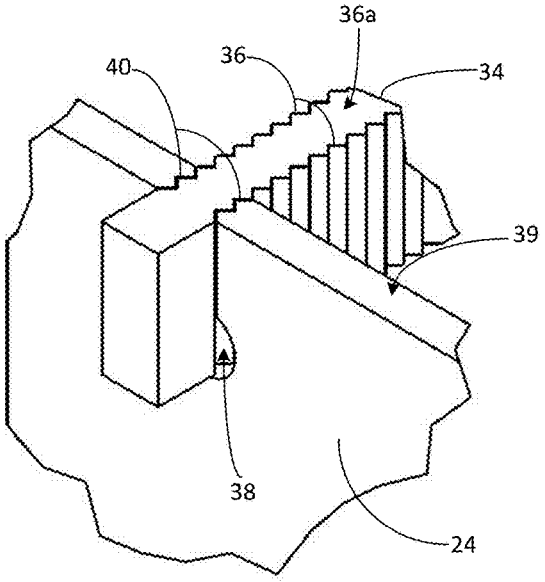

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Referring to FIGS. 1A-1E, a first embodiment of an adjustable suspended roll packaging system is shown. The packing system includes a base platform, designated generally as 10. Base platform 10 includes a series of base support beams 12 carrying an arrangement of floor boards 14. Preferably, base platform 10 is arranged to allow for fork lift engagement by including recesses 16 in base support beams 12.

A plurality of lower rail members 18 are carried on an upper surface 20 of floor boards 14 of base platform 10. Lower rail members 18 are secured to upper surface 20 of base platform 10. A series of lower positioning teeth 22 are formed into each of lower rail members 18. In the illustrated embodiment, lower positioning teeth 22 are define by a series of grooves and ridges formed into lower rail members 18 and extending along at least a distal end portion 22*a* of each of rail member 18. In the embodiment of FIGS. 1A-1E, lower positioning teeth 22 are disposed only along an inner side surface 23 of rail members 18.

Referring to FIGS. 1A-1E, a first end plate 24 and a second end plate 26 engage both of lower rail members 18. First and second end plates 24, 26 are carried in an opposing laterally spaced arrangement. In the illustrated embodiment, first and second end plates 24, 26 are positioned within distal end portion 22*a* for engaging lower positioning teeth 22 of lower rail members 18. An elongated core (not pictured) that carries the material roll (not pictured) is positioned within central opening 28 in each of opposing end plates 24 and 26 to suspend the material over floor boards 14.

Figure 1D:
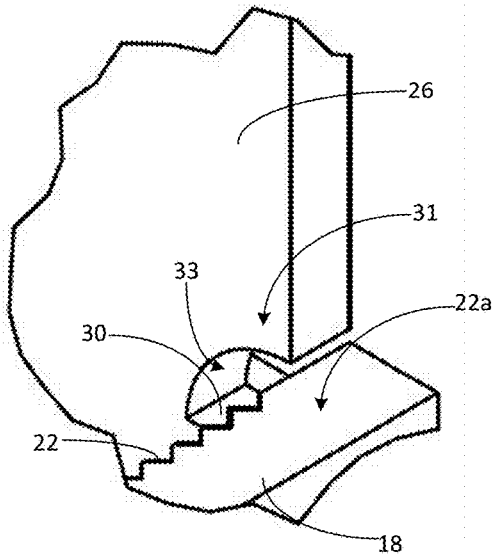
Figure 1E:
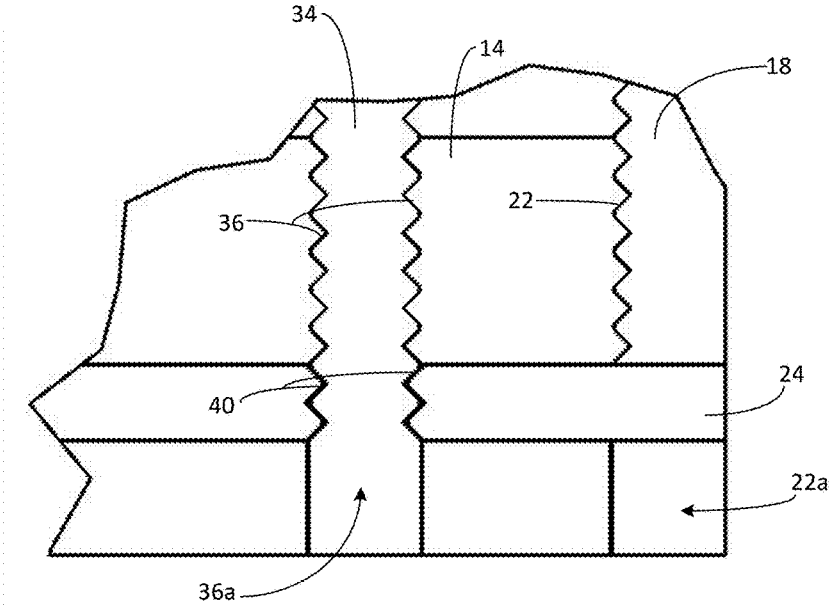

A series of lower connecting teeth 30 are included on each of first and second end plates 24 and 26. In the embodiment of FIGS. 1A-1E, lower connecting teeth 30 are disposed at the lower corners, designated generally as 31, on each of first and second end plates 24, 26 and arranged facing outward toward lower rail members 18. Referring to FIG. 1D, a notch, designated generally as 33, is carved out of each lower corner 31 of first and second end plates 24, 26, which receives lower rail members 18. Lower connecting teeth 30 are recessed in the notches and engage lower positioning teeth 22 of lower rail members 18. In the illustrated embodiment, lower rail members 18 extend between and interconnect lower corners of opposing first and second end plates 24, 26.

Figure 5A:
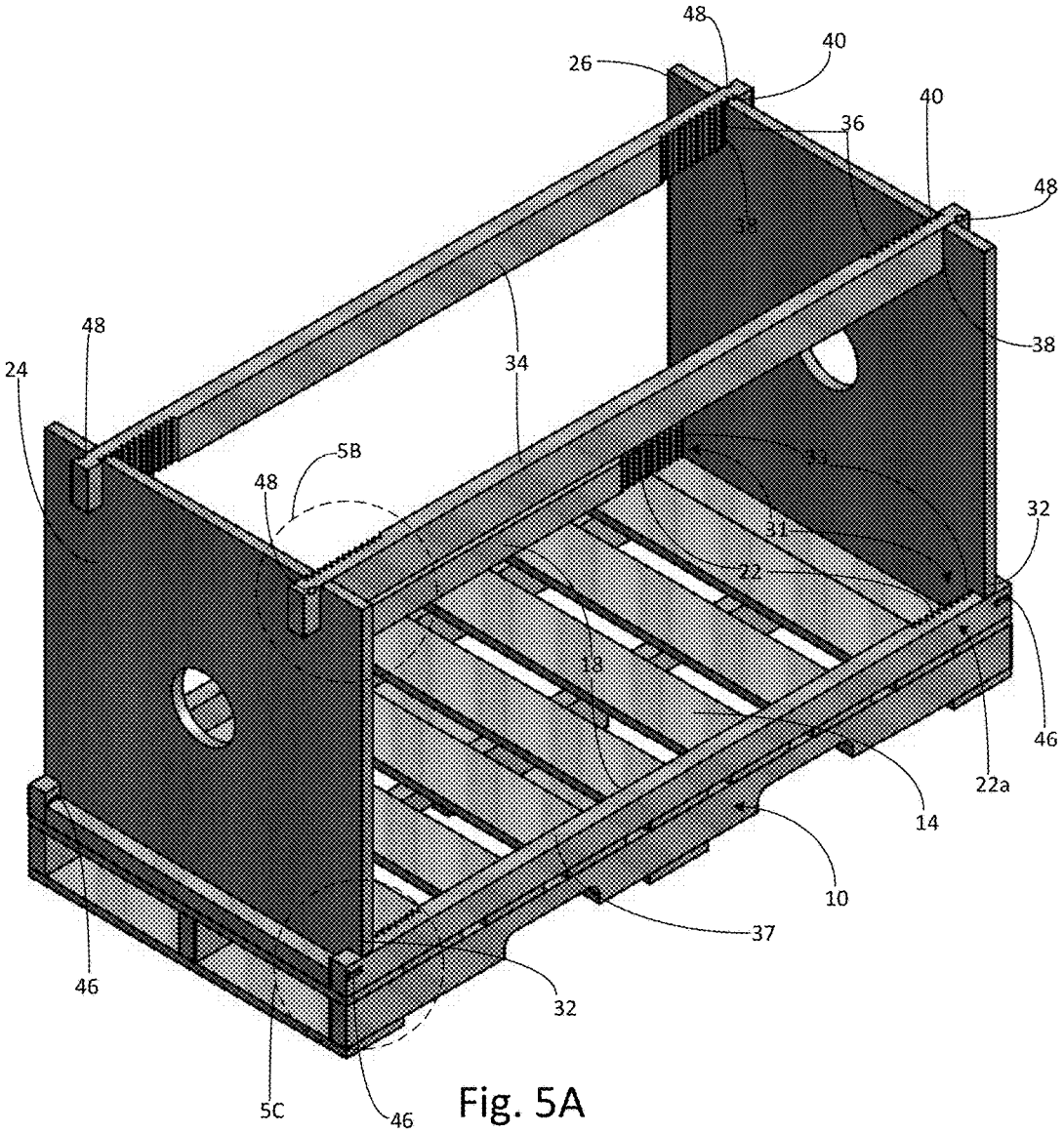
FIGS. 5A-5D show various aspects of a fifth embodiment of an adjustable suspended roll packaging system according to the present invention; and, FIGS. 6A-6B show various aspects of a sixth embodiment of an adjustable suspended roll packaging system according to the present invention It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of preferred embodiments and not restrictive of the invention or other alternate embodiments of the invention. In particular, while the invention is described herein with reference to specific embodiments, it will be appreciated that the description is illustrative of the invention and is not constructed as limiting of the invention.
Figure 6A:
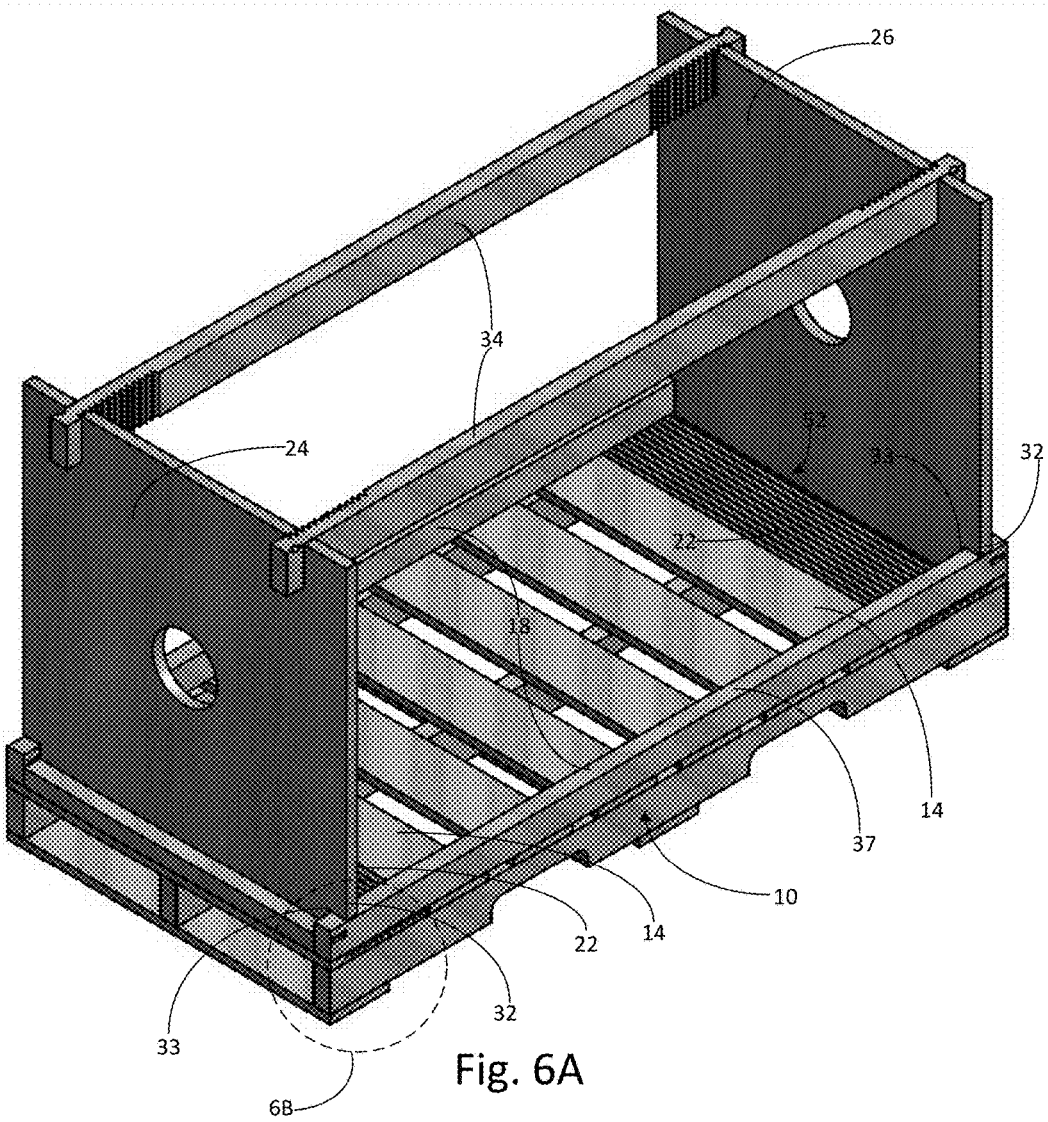

Referring to FIGS. 5A and 6A, in a further embodiment, an overhang 32 is formed by each notch in the lower corners 31 of first and second end plates 24, 26. In the embodiments shown in FIGS. 5A and 6A, overhang 32 can be constructed and arranged to engage a top side 37 of lower rail members 18 to assist in stabilizing end plates 24 and 26 in position relative to lower rail members 18.

Referring to FIGS. 1A-1E, lower connecting teeth 30 are complementary in shape to and adapted for engaging lower positioning teeth 22 to secure first and second end plates 24 and 26 in selected position along distal end portions 22*a* of lower rail members 18. Preferably, lower connecting teeth 30 include a plurality of teeth projected from each lower corner of first and second end plates 24 and 26. However, the arrangement can be accomplished with a single lower connecting tooth on each lower corner of first and second end plates 24, 26. First and second end plates 24 and 26 can be positioned by sliding the end plates vertically downward so that lower connecting teeth 30 engage with lower positioning teeth 22. Accordingly, repositioning first and second end plates 24, 26 simply requires raising the end plates up again, selecting the new position along distal end portions 22*a* of lower rail members 18 and lowering the end plates back down into interlocking engagement. The interlocking arrangement of the engaging complementary teeth 22 and 30 does not require any tools or other connecting members such as screws and the like.

In the illustrated embodiment of FIGS. 1A-1E, a plurality of upper rail members 34 are carried by first and second end plates 24 and 26 to reinforce an upper edge portion 39 of first and second end plates 24, 26. As illustrated, upper rail members 34 are arranged to extend along the length of base platform 10 generally parallel with lower rail members 18. Upper rail members extend from first end plate 24 to second end plate 26 and interconnect upper edge portions 39 on each of first and second end plates 24, 26. A series of upper positioning teeth 36 are formed in each of upper rail members 34. As with lower positioning teeth 22, upper positioning teeth 36 are define by a series of grooves and ridges extending along at least a portion of each of upper rail members 34. In the illustrate embodiment, upper positioning teeth 36 are disposed along a distal end portion 36*a* in a complementary arrangement to lower rail members 18 and lower positioning teeth 22.

Each of upper rail members 34 are received into a respective upper slots 38 disposed along an upper edge portion 39 of first and second end plates 24 and 26. A series of complementary upper connecting teeth 40 are disposed in upper slots 38 for engaging upper positioning teeth 36 to secure first and second end plates 24 and 26 in position along distal end portion 36*a* of upper rail members 34 in interlocking engagement.

In the embodiment of FIGS. 1A-1E, upper positioning teeth 36 are preferably disposed along both vertical opposite side surfaces of upper rail members 34. Upper slots 38 include complementary upper connecting teeth 40 on opposing side surfaces so that a first side surface of upper slots 38 engage with a first side surface of upper rail members 34 in interlocking engagement, and a second side surface of upper slots 38 engage with a second side surface of upper rail members 34 in interlocking engagement.

Upper connecting teeth 40 are complementary in shape to and adapted for engaging upper positioning teeth 36 to secure the upper edge portion 39 of first and second end plates 24 and 26 in selected position along distal end portions 36*a* of upper rail members 34. Preferably, upper connecting teeth 40 include at least two teeth projected from vertical opposing side surfaces within each of upper slots 38 for engaging complementary upper positioning teeth on the vertical side surface of each upper rail member 34. First and second end plates 24 and 26 can be positioned relative to upper rail members 34 by sliding rail members 34 vertically upward out of upper slots 38, repositioning first and second end plates relative to lower rail members 18 as detailed above, and then lowering upper rail members 34 back into interlocking engagement within upper slots 38 so that upper connecting teeth 40 engage with upper positioning teeth 36. The interlocking arrangement of the engaging complementary teeth 36 and 40 does not require any tools or other connecting members such as screws and the like.

Figure 2A:
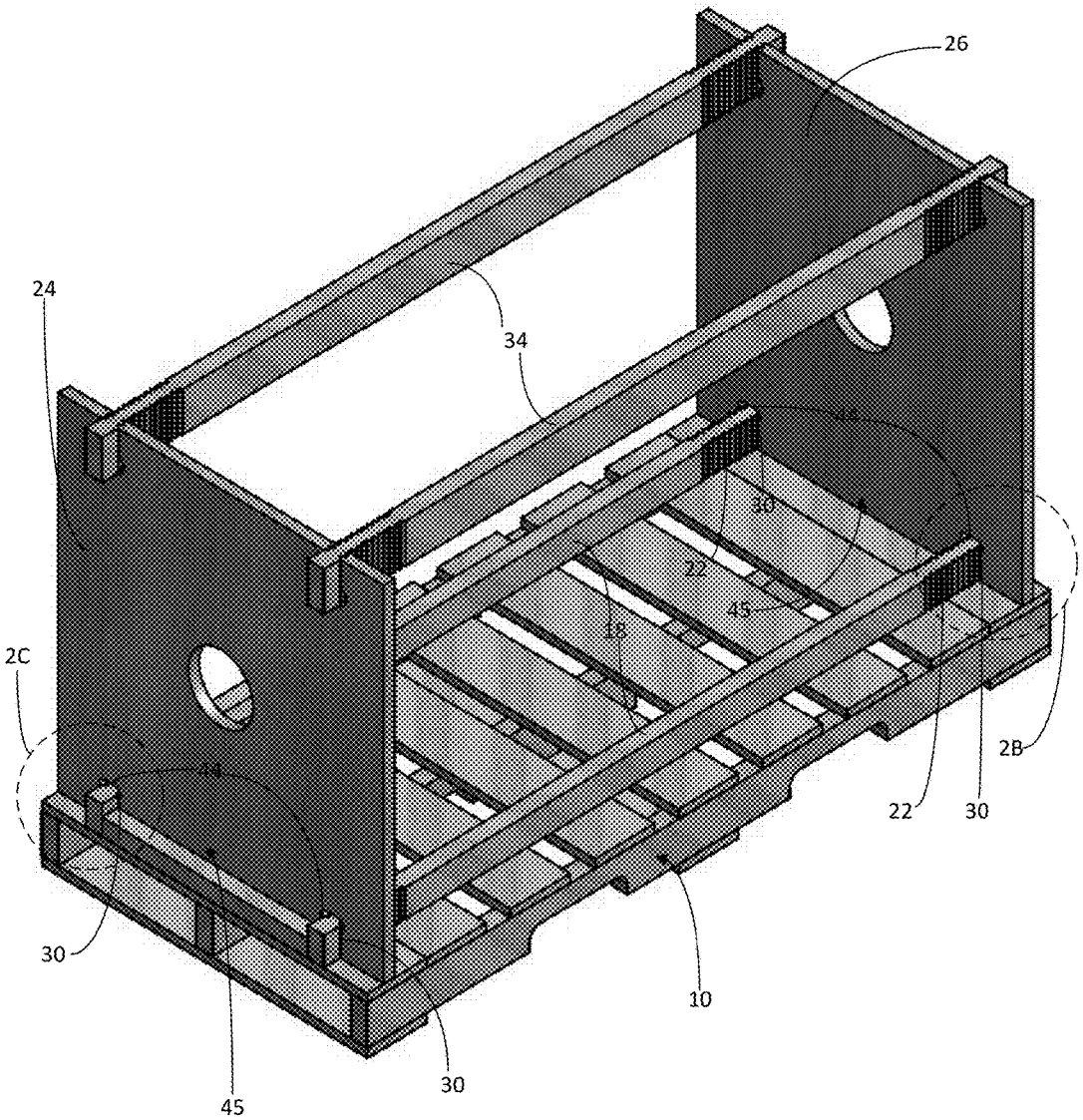
FIGS. 2A-2C show various aspects of a second embodiment of an adjustable suspended roll packaging system according to the present invention.
Figure 2B:
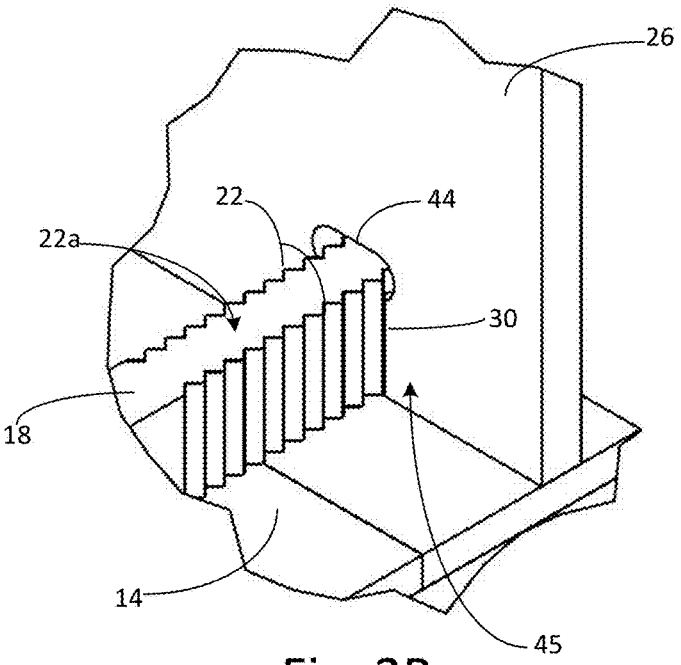
Figure 2C:
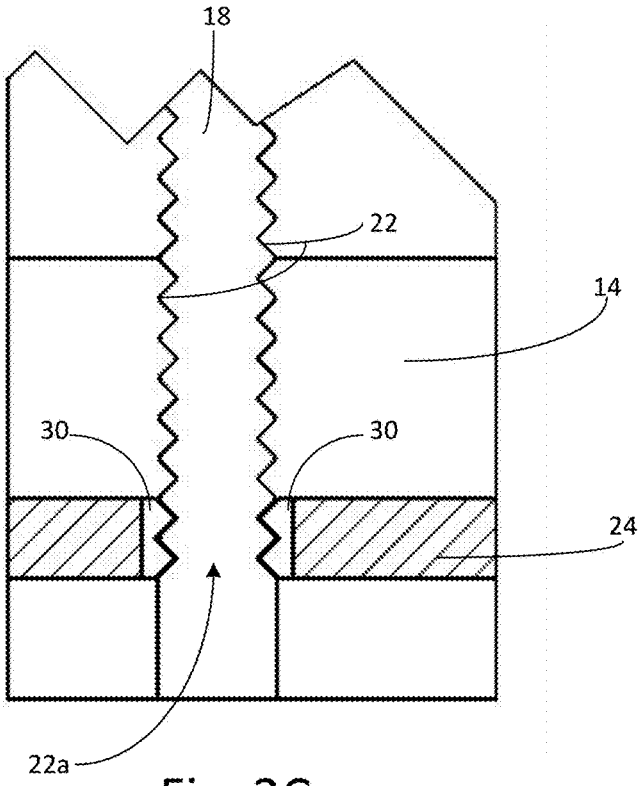

Referring to FIGS. 2A-2C, in this alternative embodiment of the packaging system, lower rail members 18 include lower positioning teeth 22 disposed on both vertical side surfaces to increase interlocking engagement with first and second end plates 24, 26. Accordingly, first and second end plates 24 and 26 now each include a plurality of lower slots 44 along a lower edge portion 45 for receiving lower rail members 18 in the same arrangement as upper rail members 34 are received into upper slots 38 in the embodiment of FIGS. 1A-1E.

In the illustrated embodiment of FIGS. 2A-2C, a series of complementary lower connecting teeth 30 are disposed on opposing side surfaces of lower slots 44 for engaging lower positioning teeth 22 on both sides of lower rail members 18 to secure first and second end plates 24 and 26 in position along lower rail members 18. Thus, by engaging both vertical side surfaces of lower rail members 18 with interlocking teeth, the interlocking engagement is effectively doubled.

Referring to FIG. 2A, in the illustrated embodiment, lower rail members 18 extend across upper surface 20 from first end plate 24 to said second end plate 26 and interconnect lower edge portion 45 on each of first and second end plates 24, 26.

Figure 3:
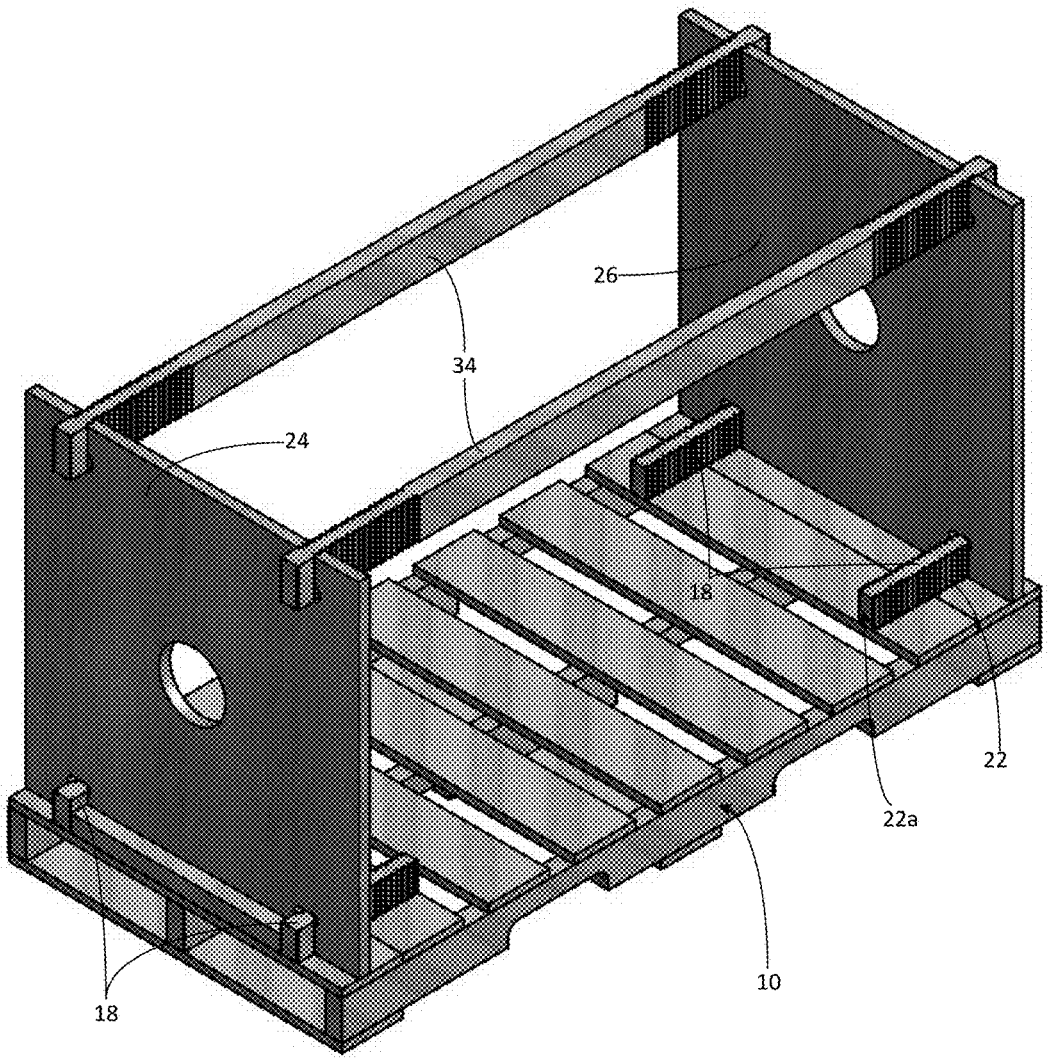
FIG. 3 shows a perspective view of a third embodiment of an adjustable suspended roll packaging system according to the present invention.

Referring to FIG. 3, an alternative embodiment of the packaging system is illustrated in which lower rail members 18 are segmented into a plurality of smaller portion for cooperating with first and second end plates 24 and 26 in the same interlocking engagement described above in the embodiment of FIGS. 2A-2C. In the embodiment of FIG. 3, each of the smaller lower rail members 18 is secured to base platform 10. Lower rail members 18 again include a series of lower positioning teeth 22 extending along both vertical side surfaces of each rail member 18. In the illustrated embodiment of FIG. 3, first and second end plates 24 and 26 again each include lower slots 44 along lower edge portions 45 for receiving lower rail members 18 in the same arrangement detailed above for FIGS. 2A-2C. A series of complementary lower connecting teeth 30 are disposed in lower slots 44 for engaging lower positioning teeth 22 to secure first and second end plates 24 and 26 in position along lower rail members 18. Thus, by engaging both vertical side surfaces of lower rail members 18 with interlocking teeth, the interlocking engagement is effectively doubled, but without lower rail members 18 extending between first and second end plates 24, 26 along the length of base platform 10 as may be required to accommodate certain material rolls, as well as reducing some material costs associated with rail members 18.

Figure 4:
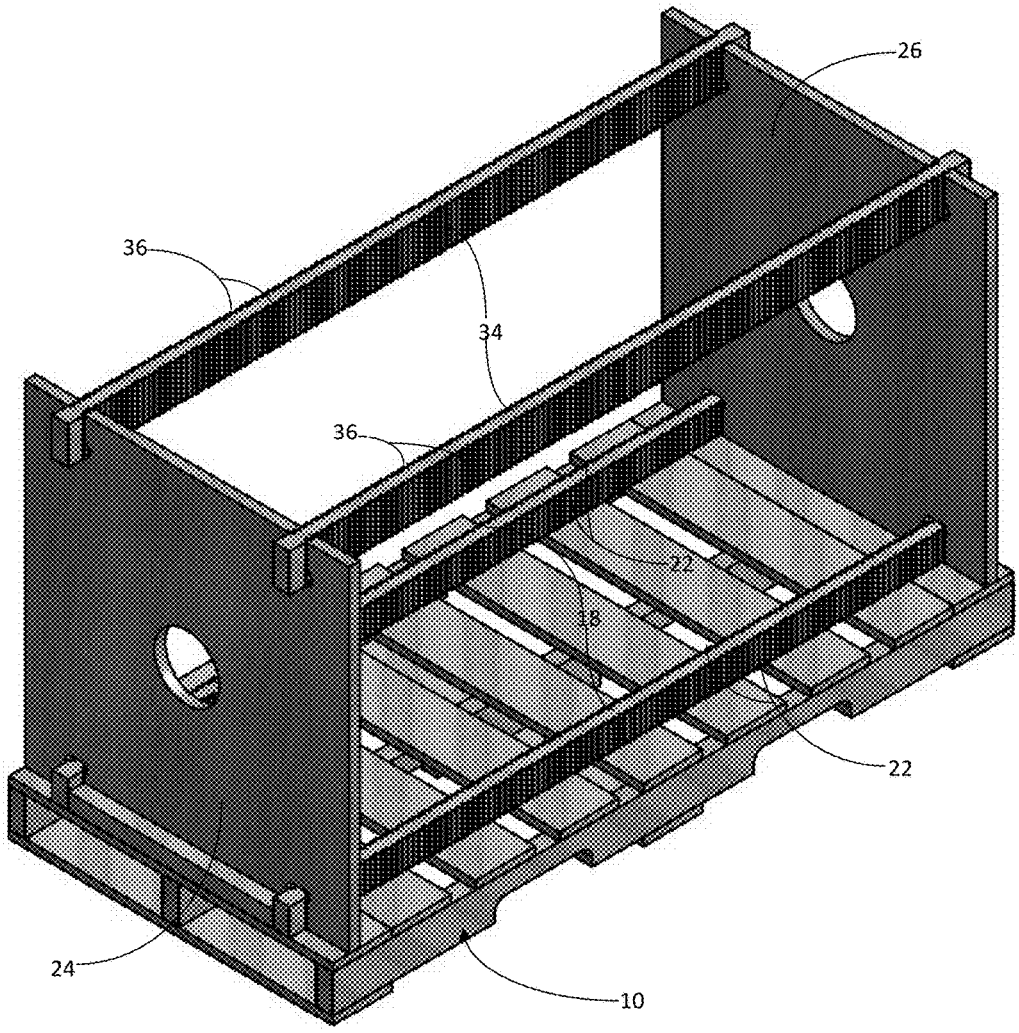
FIG. 4 shows a perspective view of a forth embodiment of an adjustable suspended roll packaging system according to the present invention.

Referring to FIG. 4, this alternative embodiment of the packaging system is shown that is largely similar in arrangement to the embodiment of FIGS. 2A-2C, with the exception that lower positioning teeth 22 of lower rail members 18 and upper positioning teeth 36 of upper rail members 34 extended entirely along the length of both vertical side surface on the lower and upper rail members 18, 34 from a first distal end portion to a second distal end portion. Accordingly, upper and lower slots 38 and 44 of first and second end plates 24 and 26 are repositionable for interlocking engagement at any location along the length of upper and lower rail members 34 and 18 to provide maximum flexibility in accommodating various material roll lengths.

Figure 5B:
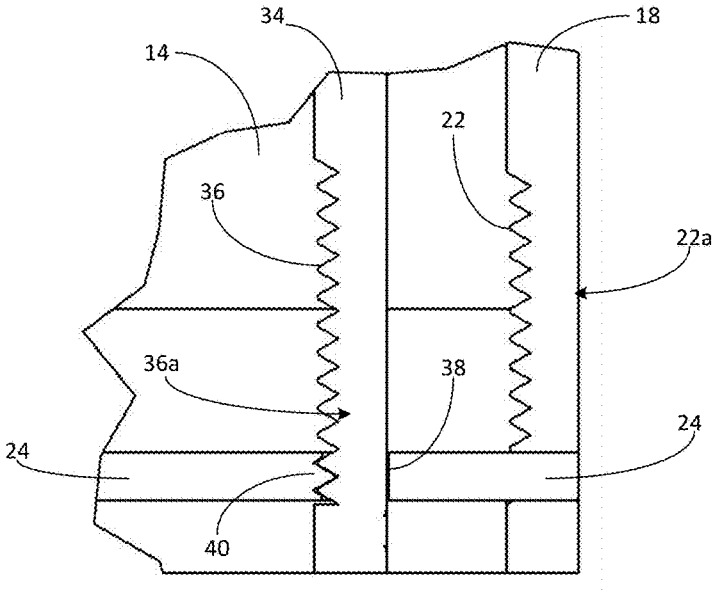

Referring to FIGS. 5A-5D, a further embodiment of the packaging system is shown having an arrangement similar to the embodiment of FIGS. 1A-1E, except that upper rail members 34 illustrate upper positioning teeth 36 disposed along a single vertical side surfaces of upper rail members 34. As best shown in FIG. 5B, upper slots 38 of first and second end plates 24, 26 includes complementary upper connecting teeth 40 disposed on only one side surfaces of the slot for engaging upper positioning teeth 36 of upper rail members 36 in interlocking engagement.

Referring to FIG. 5A, lower rail members 18 engage first and second end plates in the same basic manner as described above for FIGS. 1A-1E. As such, lower connecting teeth 30 on each of first and second end plates 24 and are disposed at the lower corners, designated generally as 31, and arranged facing outward toward lower rail members 18. Notches 33 receives lower rail members 18. Lower connecting teeth 30 are recessed in the notches and engage lower positioning teeth 22 of lower rail members 18. In the illustrated embodiment, lower rail members 18 extend between and interconnect lower corners of opposing first and second end plates 24, 26. Overhang 32 engages top side 37 of lower rail members 18 to assist in stabilizing end plates 24 and 26 in position relative to lower rail members 18.

Figure 5C:
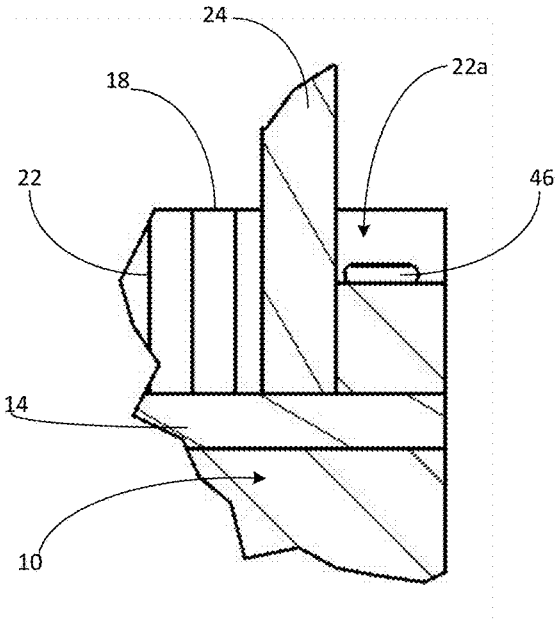

Referring to FIGS. 5A and 5C, distal end portions 22*a* of lower rail members 18 include a strap slot 46 for receiving a securing strap. Additionally, in the illustrated embodiment of FIGS. 5A and 5D, a bull nose banding notch 48 is disposed in distal end portion 36*a* of upper rail members 34. Accordingly, a securing strap can be passed though strap slot 46 in lower rail members 18 and over upper rail members 34 at bull nose banding notch 48 to interconnect upper and lower rail members 18, 34 to resist separation of the rail members from first and second end plates 24, 26. Securing strap 46 and bull nose banding notch 48 can be applied and used in each embodiment detailed herein as desired to improve resilience of the packaging system.

Figure 5D:
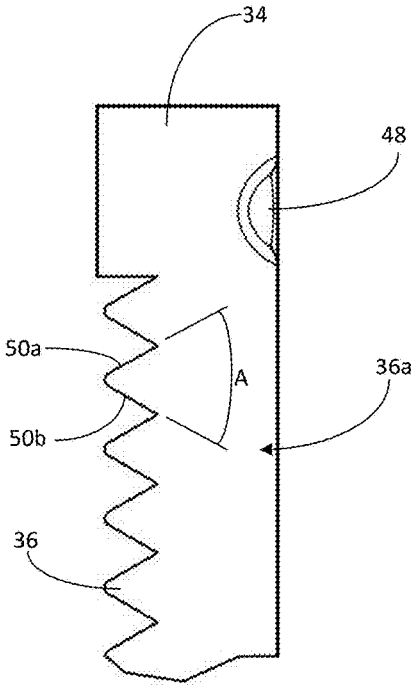

Referring to FIG. 5D, for each of the embodiments detailed herein, each tooth of upper and lower connecting teeth 40, 30 and upper and lower positioning teeth 36, 22 has two inclined engaging surfaces 50*a* and 50*b* intersecting at a peak in which opposing tooth engaging surfaces 50*a* and 50*b* are angled at approximately 60 degrees relative to each other, designated generally as angle "A".

Figure 6B:
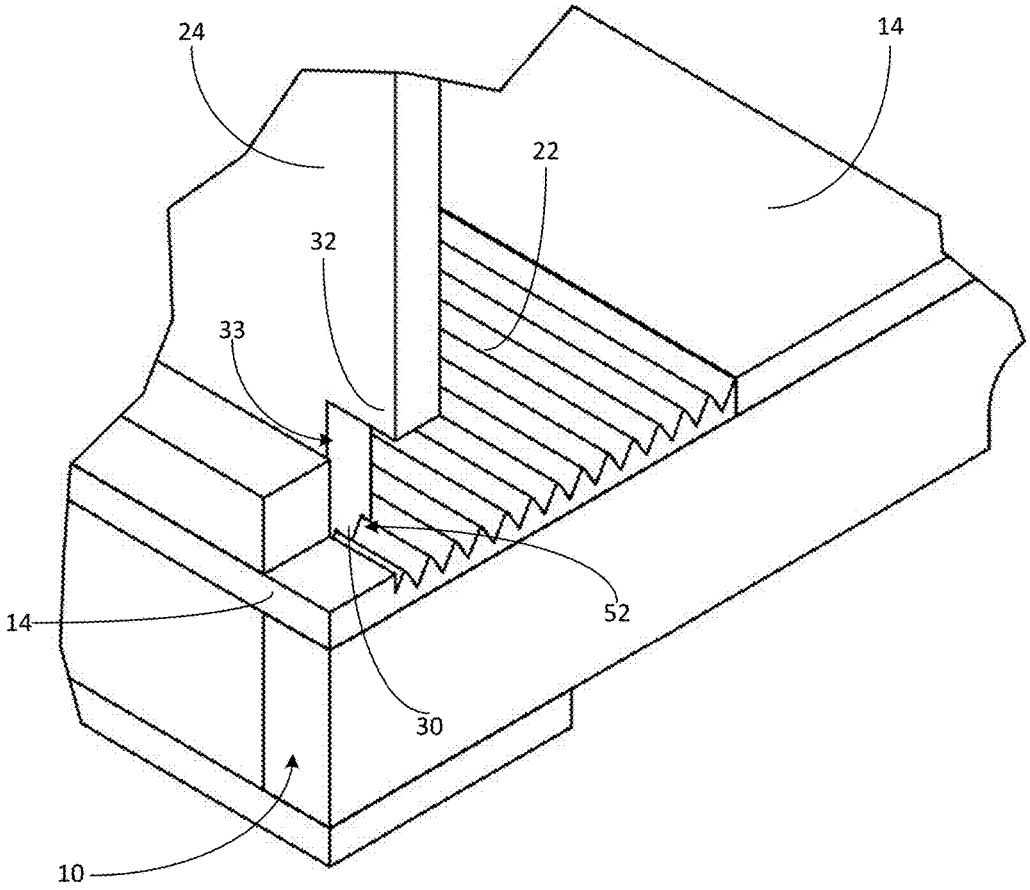

Referring to FIGS. 6A-6B, a further embodiment of the packaging system is shown having an arrangement similar to the embodiment of FIGS. 5A-5D, except that lower positioning teeth 22 are moved from lower rail members 18 to floor boards 14 of base platform 10. In the illustrated embodiment, a series of lower positioning teeth 22 are formed in an upper surface of base platform 10 on floor boards 14. At least one connecting tooth 30 is disposed on a lower edge surface, designated generally as 52 (FIG. 6B), of each of first and second end plates 24, 26 engaging lower positioning teeth 22 on floor boards 14 of base platform 10 in interlocking engagement.

As noted above, a notch 33 is included in each lower corner of first and second end plates 24, 26 receiving lower rail members 18 so that overhang 32 engages top side 37 of lower rail members 18 to assist in stabilizing end plates 24 and 26 in position relative to lower rail members 18. While no lower positioning teeth 22 are disposed in notch 33 for engaging lower rail members 18, the arrangements described in the above alternative embodiments for interconnecting first and second end plates 24, 26 with lower rail members 18 can be used in combination with the arrangement of FIGS. 6A-6B in which lower positioning teeth 22 are included on floor boards 14 and lower connecting teeth 30 are also included on lower edge surface 52.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An adjustable suspended roll packaging system comprising:

a base platform;

a plurality of lower rail members carried by an upper surface of said base platform;

a first end plate engaging said lower rail members;

a second end plate engaging said lower rail members in an opposing laterally spaced arrangement with said first end plate;

a series of lower positioning teeth formed in each of said lower rail members;

a series of complementary lower connecting teeth included on each of said first and second end plates engaging said lower positioning teeth of said lower rail members securing said first and second end plates to said lower rail members;

a plurality of upper rail members carried by said first and second end plates;

a series of upper positioning teeth formed in each of said upper rail members;

a series of complementary upper connecting teeth included on each of said first and second end plates engaging said upper positioning teeth of said upper rail members securing said first and second end plates to said upper rail members;

a plurality of upper slots disposed in an upper edge portion on each of said first and second end plates, and said upper connecting teeth disposed in said upper slots, wherein said upper rail members are received in said upper slots so that said upper positioning teeth of said upper rail members engage said upper connecting teeth in said upper slots in interlocking engagement; and, wherein said series of upper and lower connecting teeth provide for said first and second end plates to be repositionable along at least a portion of said upper and lower rail members to adjust the spacing between said first and second end plates.

2. The packaging system of claim 1 wherein said upper rail members extend from said first end plate to said second end plate and interconnect an upper edge portion on each of said first and second end plates.

3. The packaging system of claim 1 wherein said upper rail members extend parallel with said lower rail members.

4. The packaging system of claim 1 wherein said upper positioning teeth on said upper rail members extend along the length of said upper rail members from a first distal end portion to a second distal end portion.

5. The packaging system of claim 1 wherein said upper rail members include upper positioning teeth disposed on opposite side surfaces, and said upper slots include upper connecting teeth on opposing side surfaces so that a first side surface of said upper slots engage with a first side surface of said upper rail members in interlocking engagement, and a second side surface of said upper slots engage with a second side surface of said upper rail members in interlocking engagement.

6. The packaging system of claim 1 wherein said lower rail members extend from said first end plate to said second end plate and interconnect a lower edge portion on each of said first and second end plates.

7. The packaging system of claim 1 including a notch in each lower corner of said first and second end plates receiving said lower rail members, and said lower connecting teeth disposed in said notches engaging said lower positioning teeth of said lower rail members.

8. The packaging system of claim 1 wherein said lower positioning teeth on said lower rail members extend along the length of said lower rail members from a first distal end portion to a second distal end portion.

9. The packaging system of claim 1 including a plurality of lower slots disposed in a lower edge portion on each of said first and second end plates, and said lower connecting teeth disposed in said lower slots, wherein said lower rail members are received in said lower slots so that said lower positioning teeth of said lower rail members engage said lower connecting teeth in said lower slots in interlocking engagement.

10. The packaging system of claim 9 wherein said lower rail members include lower positioning teeth disposed on opposite side surfaces, and said lower slots include lower connecting teeth on opposing side surfaces so that a first side surface of said lower slots engage with a first side surface of said lower rail members in interlocking engagement, and a second side surface of said lower slots engage with a second side surface of said lower rail members in interlocking engagement.

11. The packaging system of claim 1 including a strap slot disposed in a distal end portion of said lower rail members for receiving a securing strap.

12. The packaging system of claim 1 wherein each tooth of said upper and lower connecting teeth and said upper and lower positioning teeth has two inclined engaging surfaces intersecting at a peak in which opposing tooth engaging surfaces are angled at approximately 60 degrees relative to each other.

* * * * *